United States Patent [19]

Tonn et al.

[11] Patent Number: 4,953,727

[45] Date of Patent: Sep. 4, 1990

[54] PISTON AND SHAFT ASSEMBLY OF RAILROAD END-OF-CAR CUSHIONING DEVICES AND METHOD OF REPAIRING SAME

[75] Inventors: Howard E. Tonn, Lombard; Robert Davidson, Vernon Hills; David B. Shultz, Villa Park; Keith R. Miller, Schiller Park, all of Ill.

[73] Assignee: Co-Ordinated Railway Services, Inc,, Broadview, Ill.

[21] Appl. No.: 374,954

[22] Filed: Jul. 3, 1989

[51] Int. Cl.[5] ..... B61G 9/12

[52] U.S. Cl. ..... 213/8; 213/43

[58] Field of Search ..... 29/402.08, 402.03, 426.4, 29/426.5, 434, 156 A, 156 R; 213/8, 43, 223

[56] References Cited

U.S. PATENT DOCUMENTS 3,791,534 2/1974 Stephenson ..... 213/8

*Primary Examiner*—Joseph F. Peters, Jr.
*Assistant Examiner*—Virna Lissi Mojica
*Attorney, Agent, or Firm*—Kinzer, Plyer, Dorn, McEachran & Jambor

[57] ABSTRACT

This invention concerns an end-of-car hydraulic cushioning device for use on rail cars and a method of repairing such devices. The cushioning device has a piston and shaft assembly which is subject to train action forces. The piston and shaft are connected by means of a threaded engagement which prevents relative axial movements between the two parts. Rotational movement of the piston on the shaft is prevented by a hardened steel pin disposed in aligned, radial holes formed in the piston and shaft. The pin and holes are sized to provide clearance between the piston and pin. This permits piston metal deformation to occur during high speed impacts without catastrophically stressing the steel pin. A filler rod retains the pin in the radial holes.

7 Claims, 1 Drawing Sheet

PISTON AND SHAFT ASSEMBLY OF RAILROAD END-OF-CAR CUSHIONING DEVICES AND METHOD OF REPAIRING SAME

BACKGROUND OF THE INVENTION

This invention relates to apparatus which is a component of end-of-car hydraulic cushioning devices used on railroad cars and a method of repairing such devices. The present invention provides a shaft and piston arrangement for such cushioning devices which facilitates repair should either of these parts become damaged.

End-of-car hydraulic cushioning devices have been used on railroad cars to dampen train action buff and draft forces. Such cushioning devices are known in the art, as represented in U.S. Pat. Nos. 3,589,527 and 3,752,329. The cushioning devices disclosed in these patents, as well as other cushioning devices in use today, utilize a one-piece piston and shaft arrangement to transfer outside coupling forces through a hydraulic fluid-filled housing. As the piston and shaft move through the housing, they displace, hydraulic fluid. The fluid is metered through valves and other orifices in the housing to absorb energy.

Each end-of-car hydraulic cushioning device is designed to fit in a center sill pocket at an end of the railroad car. The shaft includes an end normally provided with a spherical bearing which connects to the car body. The housing is connected to the coupler and is slidable within the sill pocket. The housing has metal stops which engage similar limiting stops fixed on the inside of the sill. These engaging stops limit the length of travel of the housing relative to the piston and shaft as buff and draft forces act upon the railroad car coupler, extending and compressing the cushioning device in its center sill pocket location.

As explained in U.S. Pat. Nos. 4,719,686 and 4,782,740, the disclosures of which are incorporated by reference herein, the cushioning devices are subject to wear which may result in damage to either the piston or shaft, or both. These two patents describe a method and apparatus for repairing a damaged piston and shaft assembly. Specifically, the patents describe how to reuse a piston taken off of a damaged shaft. The method involves the use of a threaded connection between a used piston and a new shaft. Stops are incorporated in the threaded connection to prevent axial movement between the piston and shaft. A threadlock adhesive is used to prevent rotational movement between the parts.

SUMMARY OF THE INVENTION

The present invention provides a piston and shaft assembly for an end-of-car hydraulic cushioning device which permits separation of the piston and shaft for replacement of a damaged component. The present invention incorporates the threaded connection between the piston and shaft shown in U.S. Pat. Nos. 4,719,686 and 4,782,740. The present invention provides a method and apparatus for preventing rotational movement of the piston on the shaft. A hardened steel pin is disposed in aligned radial holes extending through the piston and into the shaft. The pin extends across the interface between the piston and shaft in the threaded portion of the shaft. When inserted, the pin provides interference between the piston and shaft, restricting rotation of the piston on the shaft. The aligned holes have a diameter somewhat larger than the diameter of the pin to provide clearance between the pin and the piston. This clearance allows the piston to deform during heavy impacts without causing pin failure.

To assure that the pin is retained, a nylon filler rod is used to fill the remaining bored hole in the piston. The nylon filler rod abuts the hardened steel pin in the hole and terminates at the piston's circumference. The nylon pin has an interference fit with the bored piston hole and is captured either by the piston's circumferential wear ring or by peening the piston metal adjacent the radial hole.

DETAILED DESCRIPTION OF THE INVENTION

Figure 1:
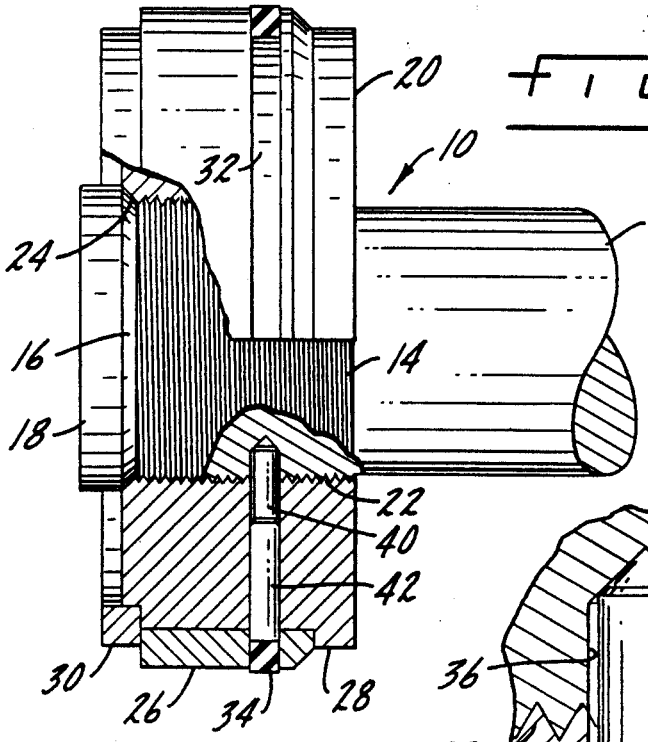
FIG. 1 is a side view, in partial cross-section, of a portion of a piston and shaft assembly used in end-of-car hydraulic cushioning devices.

The accompanying drawings illustrate a portion of a piston and shaft assembly for use in an end-of-car hydraulic cushioning device for use on railroad cars. It will be understood that the assembly will include the usual spherical bearing, although this is not shown in the drawings.

Looking at the embodiment of FIG. 1, the piston and shaft assembly 10 includes a shaft 12 having a threaded portion 14 at one end. Adjacent the threaded portion 14 is a chamfer 16 which adjoins a stop 18.

The piston 20 has an axial bore cut therethrough. Internal threads 22 are cut in the wall of the bore. The threads terminate at a chamfer 24 which is cut at one end of the bore. The chamfer 24 engages the chamfer 16 of the stop 18 to limit movement of the piston 20 along the shaft 12. The piston also has a circumferential collar 26 held against a shoulder 28 of the piston by a retainer ring 30. The collar 26 has a wear ring groove 32 formed therein. A wear ring 34 is disposed in the groove 32.

Figure 2:
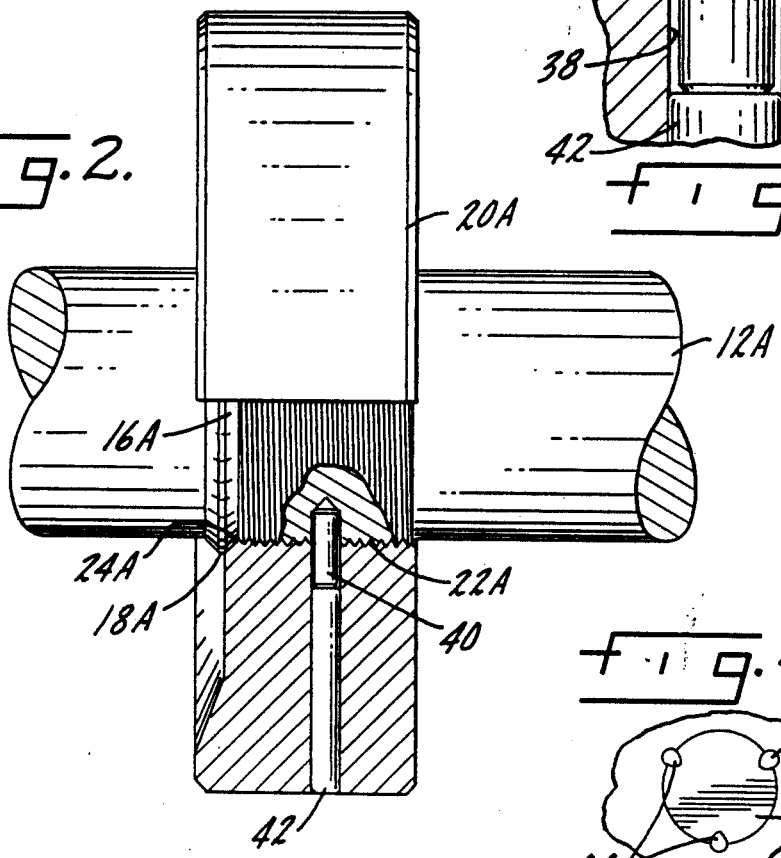
FIG. 2 is a side view, in partial cross-section, of another type of piston and shaft assembly.

FIG. 2 illustrates another typical embodiment of a piston and shaft assembly. This assembly includes a piston 20A and shaft 12A. In this embodiment, the piston is disposed along the length of the shaft 12A rather than at an end. The piston has threads 22A and a chamfer 24A. The shaft has a chamfer 16A and stop 18A. The piston 20A does not have a collar or wear ring in this embodiment.

Figure 3:
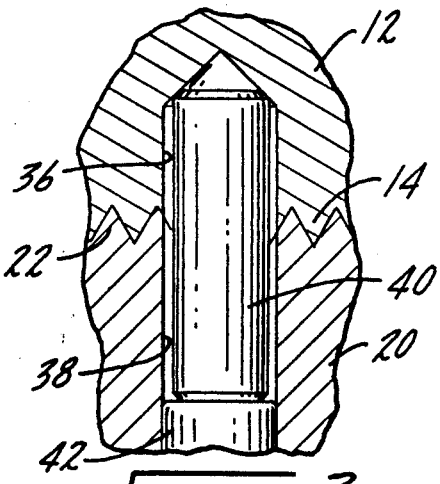
FIG. 3 is an enlarged detail view of the pin disposed in the aligned radial holes of the piston and shaft.
Figure 4:
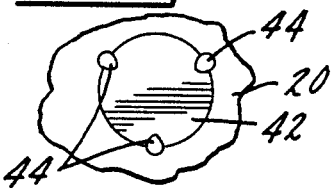
FIG. 4 is an end view of a filler rod retained in a piston by peening.

Looking at FIG. 3, an enlarged detail view is shown. This view is applicable to either embodiment. The shaft 12 has a radially-extending hole 36 in the area of the threaded portion 14. The piston 20 has a radial hole 38 extending therethrough. When the piston is mounted in place on the shaft, the hole 38 is aligned with the hole 36. A hardened steel pin 40 is disposed in the aligned holes. The pin extends across the interface of the threads 14 and 22. The pin is held in place by a nylon filler rod 42, which is used to fill the remaining bored hole in the piston radius. The nylon filler rod abuts the steel pin 40 in the bored piston hole and terminates at the piston's circumference. The nylon pin has an interference fit with the bored piston hole 38 and is captured in the FIG. 1 form by the circumferential wear ring 34. On pistons with no wear ring provision, the nylon filler rod 42 is retained by peening of the piston metal, as at 44, shown in FIG. 4.

It will be noted in FIG. 3 that the diameter of the shaft hole 36 and radial hole 38 of the piston are greater than the diameter of the pin 40. For purposes of illustration, the pin may be one inch long with a 5/16-inch diameter. The radial holes through the piston and shaft threaded connection is 3-⅜ inches in length and ⅜ inches in diameter. When inserted, the pin provides an interference between the piston and shaft, restricting rotation of the threaded piston on the threaded shaft. The 1/32-inch clearance between the pin and radial hole of the piston allows the piston metal to deform during high speed impacts without catastrophically stressing the hardened pin which would cause pin failure.

The method of the invention includes the steps of separating the pieces of the damaged assembly and replacing the bad part with a new one. The separating step may entail the removal of a pin from the radial holes, if there is a pin, and relative rotation of the piston and shaft to disengage them. Or, if the damaged assembly does not have a threaded piston-shaft connection, the replacement of the bad part may entail the cutting, boring and threading operations described in U.S. Pat. No. 4,719,686. The new piston and shaft are joined by threading them together. Then the assembly is bored to form the aligned radial holes. Next the pin is placed in the newly formed radial holes and the retainer means is affixed to hold the pin in place.

The construction shown provides a sturdy connection between the piston and shaft, which will meet all applicable load-carrying specifications. Furthermore, the connection of this invention facilitates repair of the assembly by allowing reuse of one of the parts of the assembly should the other one become damaged. Specifically, should one of the piston or shaft be damaged, the filler rod 42 and pin 40 can be removed from the radial holes and the piston will then be free to be rotated off of the shaft. The damaged part can be replaced by a new one and the undamaged part is immediately ready for reuse.

While a preferred form of the invention has been shown and described, it will be understood that alterations may be made thereto without departing from the scope of the following claims.

We claim:

1. A piston and shaft assembly for an end-of-car cushioning device, comprising:

a shaft having a threaded portion formed on the shaft surface and a radially-extending hole formed in the shaft in the area of the threaded portion;

a piston having an axial bore through its center with threads formed on the surface of the axial bore, said bore's threads being adapted to mate with the threads of the shaft such that the mating threads provide a positive abutment to axial movement of the piston along the shaft, the piston further including a radial hole aligned with the hole of the shaft;

a pin disposed in the aligned radial holes of the piston and shaft and extending across the interface thereof to provide positive abutment to rotational movement of the piston on the shaft, the pin having a diameter less than that of the radial hole of the piston so as to provide clearance between the pin and the piston; and retainer means for holding the pin in the radial hole.

2. The assembly of claim 1 wherein the retainer means is a deformable filler rod having a diameter such that it has an interference fit with the radial hole of the piston.

3. The assembly of claim 2 wherein the piston further comprises a circumferential groove formed on its exterior with the radial hole opening into the bottom of said groove, and a wear ring disposed in the groove such that the wear ring holds the retainer means in the radial hole.

4. The assembly of claim 2 wherein the surface of the piston surrounding the radial hole is peened to hold the retainer means in the radial hole.

5. The assembly of claim 2 wherein the filler rod is made of nylon.

6. The assembly of claim 1 wherein the shaft has a central length of a first diameter and its threaded portion is of a second outside diameter larger than the first diameter, the shaft further including a stop of a third diameter larger than the second diameter, and wherein the axial bore has a stop formed in one end thereof, adapted to mate with the stop of the shaft, the threads being adapted to mate with the threads of the shaft such that the shaft threads provide a positive abutment to axial movement of the piston along the shaft in one direction while the shaft stop provides a positive abutment to axial movement of the piston along the shaft in the other direction.

7. A method of repairing a damaged piston and shaft assembly for an end-of-car cushioning device wherein the device includes a shaft having a threaded portion formed on the shaft surface and a piston having an axial bore through its center with threads formed on the surface of the axial bore, said bore's threads being adapted to mate with the threads of the shaft such that the mating threads provide a positive abutment to axial movement of the piston along the shaft, comprising the steps of:

separating the piston from the shaft;

replacing the damaged part of the piston and shaft assembly with an undamaged one and connecting the parts by rotating the piston and shaft relative to each other so that threaded portion of the shaft engages the threaded portion of the piston;

providing radial holes through the piston and into the shaft, the radial hole in the piston being aligned with the radial hole in the shaft;

placing a pin in the aligned radial holes of the piston and shaft such that the pin extends across the interface thereof to provide positive abutment to rotational movement of the piston on the shaft, the pin having a diameter less than that of the radial hole so as to provide clearance between the pin and the piston; and applying retainer means to the piston for holding the pin in the radial hole.

* * * * *